US005969295A

United States Patent [19]

Boucino et al.

[11] Patent Number: 5,969,295

[45] Date of Patent: Oct. 19, 1999

[54] TWISTED PAIR COMMUNICATIONS CABLE

[75] Inventors: Thomas Boucino, Hickory; Mahesh R. Patel, Conover; Robert A. Wessels, Hickory, all of N.C.

[73] Assignee: CommScope, Inc. of North Carolina, Hickory, N.C.

[21] Appl. No.: 09/005,335

[22] Filed: Jan. 9, 1998

[51] Int. Cl.[6] ..... H01B 7/00

[52] U.S. Cl. ..... 174/113 C

[58] Field of Search ..... 174/113 R, 120 R, 174/113 C, 113 AS

[56] References Cited

U.S. PATENT DOCUMENTS

| | | | |
|---|---|---|---|
| 483,285 | 9/1892 | Guilleaume | 173/28 |
| 1,977,209 | 10/1934 | Sargent | 173/264 |
| 2,204,737 | 6/1940 | Swallow et al. | 174/28 |
| 2,340,926 | 2/1944 | Bradley | 138/77 |
| 3,588,313 | 6/1971 | Delves-Broughton | 174/28 |
| 3,603,715 | 9/1971 | Vinnhorst et al. | 174/15 |
| 3,621,118 | 11/1971 | Bunish et al. | 174/115 |
| 3,927,247 | 12/1975 | Timmons | 174/36 |
| 4,038,489 | 7/1977 | Stenson et al. | 174/70 R |
| 4,132,854 | 1/1979 | Kemeny et al. | 174/27 |
| 4,374,881 | 2/1983 | Hamilton | 428/36 |
| 4,683,349 | 7/1987 | Takebe | 174/69 |
| 4,729,409 | 3/1988 | Paul | 138/115 |
| 4,731,506 | 3/1988 | Lee | 174/115 |
| 4,778,246 | 10/1988 | Carroll | 350/96.23 |
| 5,132,488 | 7/1992 | Tessier et al. | 174/34 |
| 5,227,585 | 7/1993 | Zen | 174/95 |
| 5,236,016 | 8/1993 | Vogelsang | 138/115 |
| 5,305,797 | 4/1994 | Roy, Sr. | 138/108 |
| 5,493,071 | 2/1996 | Newmoyer | 174/113 R |
| 5,541,361 | 7/1996 | Friesin et al. | 174/34 |
| 5,574,250 | 11/1996 | Hardie et al. | 174/36 |
| 5,619,016 | 4/1997 | Newmoyer et al. | 174/113 R |
| 5,661,836 | 8/1997 | Sano et al. | 285/111 |
| 5,789,711 | 8/1998 | Gaeris et al. | 174/113 C |

FOREIGN PATENT DOCUMENTS

| | | | |
|---|---|---|---|
| 24 59 844 | 7/1976 | Germany | H01B 11/20 |
| 5-101711 | 4/1993 | Japan | H01B 7/02 |
| 1343447-A1 | 10/1987 | Russian Federation | H01B 11/02 |
| 2 161 656 | 7/1985 | United Kingdom | H02G 3/04 |

*Primary Examiner*—Dean A. Reichard
*Assistant Examiner*—William H Mayo, III
*Attorney, Agent, or Firm*—Alston & Bird LLP

[57] ABSTRACT

A communications cable is provided that includes a cable jacket, twisted pairs of insulated conductors, and a spacer separating the twisted pairs of insulated conductors. The spacer extends within the cable jacket and has a longitudinally extending center portion and a plurality of wall portions radiating from the center portion thereby defining a plurality of compartments within the cable jacket. The twisted pairs of insulated conductors are disposed in the compartments thereby reducing cross talk in the communications cable.

13 Claims, 3 Drawing Sheets

TWISTED PAIR COMMUNICATIONS CABLE

FIELD OF THE INVENTION

The present invention relates broadly to communications cable and more particularly, to communications cable containing at least one twisted pair of insulated conductors.

BACKGROUND OF THE INVENTION

Insulated conductors such as those used in communications cable are often provided as twisted pairs consisting of two insulated conductors twisted about each other to form a two conductor group. The typical assembly for these communications cables comprises two or more twisted pairs of insulated conductors bundled together and contained in a jacket. This assembly facilitates the installation of the cable. In addition, the jacket can be easily connected to other cable components by stripping the jacket and making the proper connections to the insulated conductors.

One problem associated with the conventional twisted pair assembly is that cross talk can occur between twisted pairs of insulated conductors thus negatively affecting the signals transmitted by these conductors. Cross talk especially presents a problem in high frequency applications because cross talk increases logarithmically as the frequency of the transmission increases. Because cross talk is affected to some degree by the distance between adjacent twisted pairs, one method of minimizing its occurrences is to space the twisted pairs apart using spacing means such as disclosed in U.S. Pat. No. 5,132,488 to Tessier et al. However, although such a construction can physically separate adjacent twisted pairs, there is still some degree of cross talk interaction between twisted pairs in this type of construction. In addition, there remains a need to provide easy connectorization between the twisted pair cable and other cable components.

SUMMARY OF THE INVENTION

In accordance with the present invention, a communications cable is provided comprising a cable jacket, twisted pairs of insulated conductors within the jacket, and a spacer separating the twisted pairs of insulated conductors. The spacer extends within the cable jacket and has a longitudinally extending center portion and a plurality of wall portions radiating from the center portion thereby defining a plurality of compartments within the cable jacket. A twisted pair of insulated conductors is disposed in respective ones of the compartments and generally a twisted pair of insulated conductors is provided in each of the compartments. In addition, the individual twisted pairs are preferably each twisted with a different lay length from the other twisted pairs of the cable.

In one embodiment of the invention, the communications cable comprises a tubular cable jacket, a spacer situated within the cable jacket and separate from the cable jacket, and twisted pairs of insulated conductors separated by the spacer. In this embodiment, the spacer has a longitudinally extending center portion and a plurality of longitudinally extending wall portions radiating from the center portion to define a plurality of compartments within the cable jacket with a twisted pair of insulated conductors disposed in each of the compartments. Preferably, the communications cable includes four compartments. The wall portions of the communications cable can also be configured so as to define compartments of a helical configuration within the cable jacket so that the respective twisted pairs located within the compartments extend helically about the longitudinal axis of the cable. Preferably, the respective twisted pairs are twisted helically at a lay length of between about 3 and about 8 inches. In order to connect the cable to other cable components, the jacket is stripped from the cable and the spacer can be moved away or removed from the twisted pairs for easy connection.

In another embodiment of the invention, the communications cable comprises a tubular cable jacket, a spacer extending longitudinally within the cable jacket, and twisted pairs of insulated conductors separated by the spacer. In this embodiment, the spacer has a longitudinally extending center portion and a plurality of longitudinally extending wall portions radiating from the center portion to the cable jacket and connected thereto such that the spacer and the cable jacket define a plurality of compartments. A twisted pair of insulated conductors is disposed in each of the compartments. In this embodiment, the longitudinally extending walls of the spacer are thin and preferably increase in thickness from the center portion to the jacket. In addition, the cables associated with this embodiment preferably define four compartments. In order to connect the cables of this embodiment to cable components, the jacket is stripped away and the thin walls of the spacer broken to provide access to the twisted pairs of insulated conductors.

The communications cable of the invention sufficiently separates individual twisted pairs from one another to reduce cross talk between twisted pairs in the cable. Specifically, because the spacer extends continuously from the center portion to the jacket, the twisted pairs are sufficiently insulated from one another thereby reducing cross talk therebetween. In addition, the cables of the invention can be easily connectorized to other cable components by stripping the cable jacket from the cable and either moving the spacer away from the twisted pairs or breaking the spacer off. Thus, the communications cable of the invention can be used in plenum for various types of applications.

BRIEF DESCRIPTION OF THE DRAWINGS

Other features and advantages of the present invention will become apparent from the following detailed description of the invention taken in conjunction with the drawings, in which.

DETAILED DESCRIPTION OF THE PREFERRED EMBODIMENTS

Figure 1:
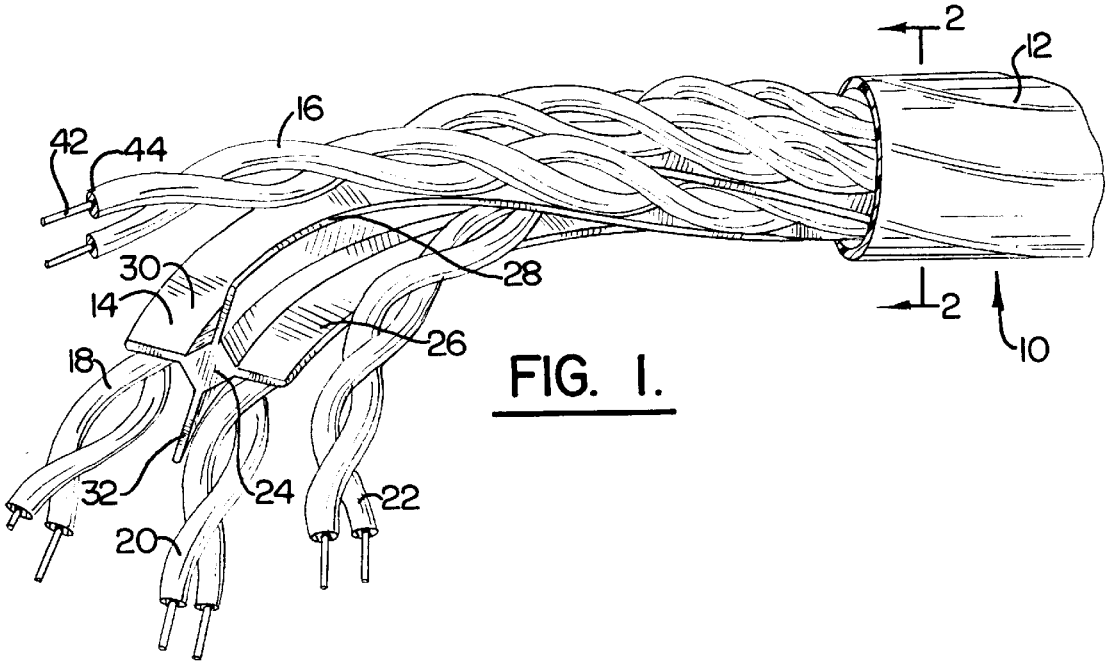
FIG. 1 is a perspective view of a communications cable having four pairs of twisted insulated conductors in accordance with the present invention.

Referring now to FIG. 1, there is shown a multi-pair communications cable designated generally by 10 having a cable jacket 12, a spacer 14, and four twisted pairs of insulated conductors 16, 18, 20 and 22. The jacket 12 surrounds the spacer 14 and the twisted pairs 16, 18, 20 and 22 and is preferably tubular in shape. The jacket 12 is made of a flexible polymer material and is preferably formed by melt extrusion. Any of the polymer materials conventionally used in cable construction may be suitably employed. Suitable polymers include polyvinylchloride, polyvinylchloride alloys, polyethylene, polypropylene and flame retardant materials such as fluorinated polymers. Preferably, the jacket 12 is extruded to a thickness of between 15 and 25 mils (thousandths of an inch) to allow the jacket to be easily stripped from the twisted pairs of insulated conductors 16, 18, 20 and 22.

Figure 2:
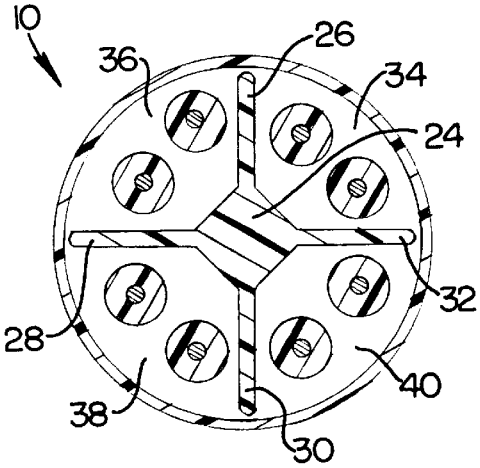
FIG. 2 is a cross-sectional view of the cable of FIG. 1 taken along lines 2—2 illustrating a spacer having four longitudinally extending walls defining four compartments in the cable wherein the spacer is separate from the surrounding jacket.
Figure 3:
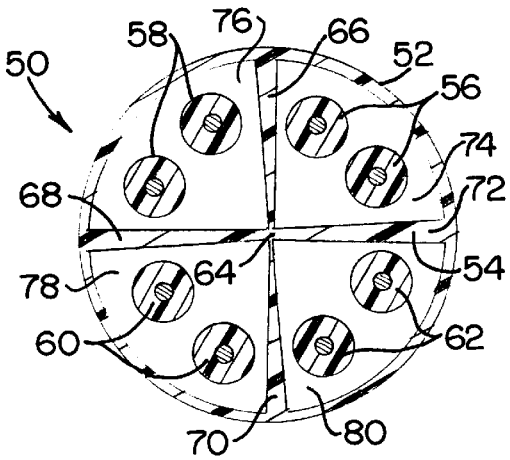
FIG. 3 is a cross-sectional view of an alternative embodiment of the invention illustrating a spacer having four longitudinally extending walls defining four compartments in the cable and connected to the surrounding jacket.
Figure 4A:
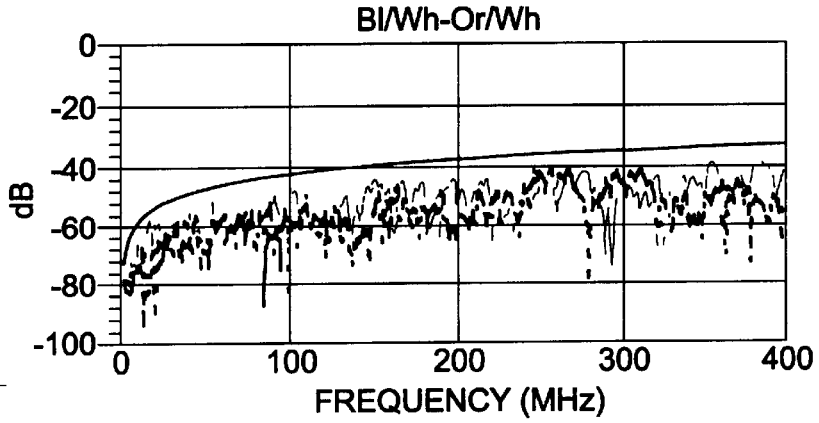
FIG. 4 is a cross talk graph comparing the communications cable of the invention to conventional cable constructions.
Figure 4B:
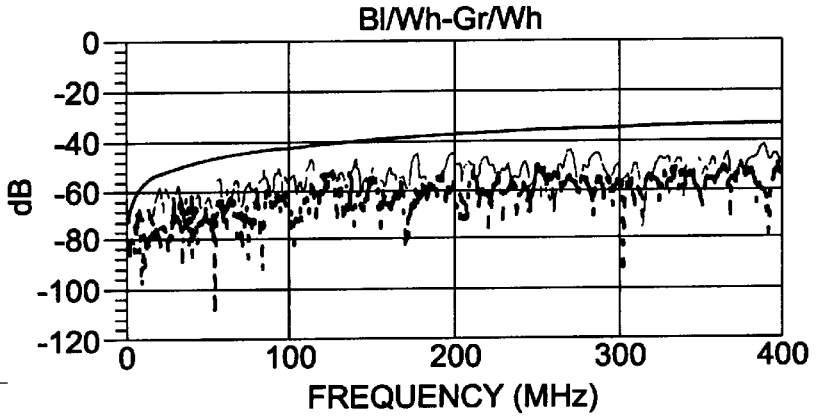
Figure 4C:
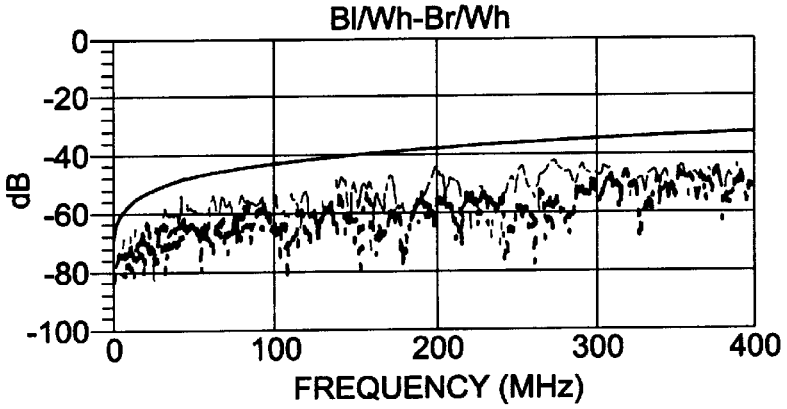
Figure 4D:
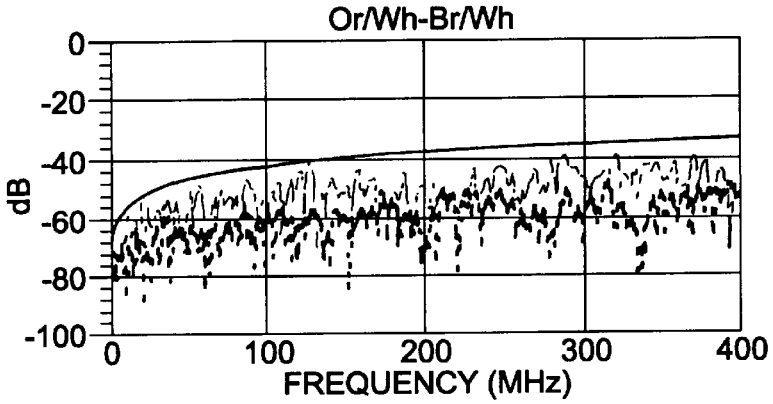
Figure 4E:
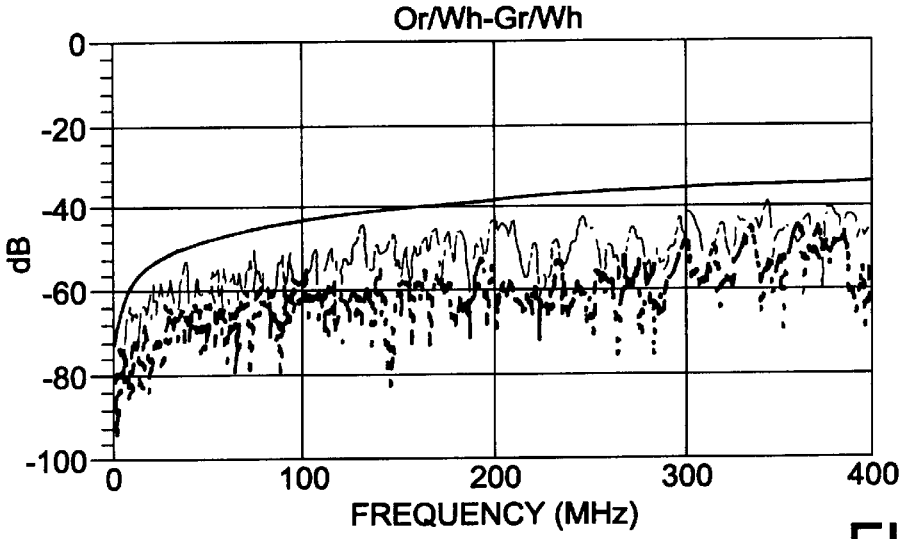
Figure 4F:
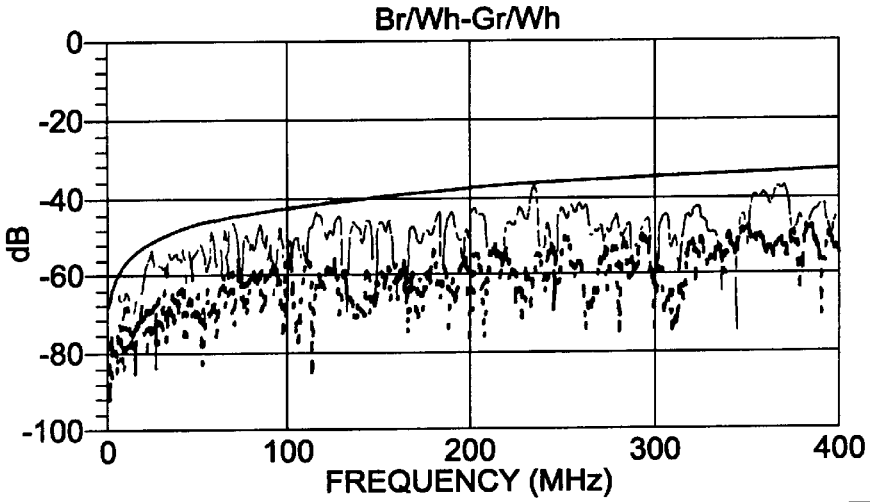

The spacer 14 is situated within and is longitudinally coextensive with the cable jacket 12. As illustrated in FIG. 2, the spacer 14 includes a longitudinally extending center portion 24 and a plurality of wall portions 26, 28, 30 and 32, radiating from the center portion. The spacer 14 defines compartments 34, 36, 38 and 40 in the jacket 12 for the twisted pairs 16, 18, 20, and 22. Each of the compartments 34, 36, 38 and 40 is of sufficient size to receive a corresponding twisted pair 16, 18, 20, and 22. The communications cable has a plurality of compartments and preferably at least four compartments to receive at least four respective insulated conductor pairs. As illustrated in FIGS. 1–3, the communications cable has four compartments for receiving twisted pairs. Although the illustrated cable can receive four insulated conductor pairs, it will be understood by those skilled in the art that not all of the compartments may include a insulated conductor pair during normal installation and operation of the cable.

As shown in FIG. 1, the insulated conductors of each twisted pair 16, 18, 20, and 22, are twisted helically around one another. The twisted pairs 16, 18, 20, and 22 are typically twisted at a lay length of between about 0.25 and about 1.50 inches. Preferably, each of the twisted pairs of insulated conductors has a different lay length from the other twisted pairs of the cable.

As shown in FIG. 1 for purposes of illustration using only one pair 16 of twisted insulated conductors, each insulated conductor in the twisted pair comprises a conductor 42 surrounded by a layer of an insulating material 44. The conductor 42 may be a metallic wire or any of the well-known metallic conductors used in wire and cable applications, such as copper, aluminum, copper-clad aluminum, and copper-clad steel. Preferably, the wire is 18 to 26 AWG gauge. The twisted wires are surrounded by a layer of the insulating material. Preferably, the thickness of the insulating material is less than about 25 mil, preferably less than about 15 mil, and for certain applications even less than about 10 mil. The insulating material can also be foamed or expanded through the use of a blowing or foaming agent. Suitable insulating materials for the twisted wires include polyvinylchloride, polyvinylchloride alloys, polyethylene, polypropylene, and flame retardant materials such as fluorinated polymers. Exemplary fluorinated polymers for use in the invention include fluorinated ethylene-propylene (FEP), ethylenetrifluoroethylene (ETFE), ethylene chlorotrifluoroethylene (ECTFE), perfluoroalkoxypolymers (PFA's), and mixtures thereof. Exemplary PFA's include copolymers of tetrafluoroethylene and perfluoropropylvinylether (e.g. Teflon PFA 340) and copolymers of tetrafluoroethylene and perfluoromethylvinylether (MFA copolymers which are available from Ausimont S.p.A.). In addition, the insulating material can contain conventional additives such as pigments, nucleating agents, thermal stabilizers, acid acceptors, processing aids, and flame retardant compositions (e.g. antimony oxide). If desired, the insulating material used for the twisted wires may not be the same for each twisted wire pair. For example, three of the wire pairs may be surrounded by a foamed polyvinylchloride and the fourth wire pair surrounded by a different insulating material such as a foamed FEP.

FIGS. 1 and 2 illustrate one embodiment of the invention wherein the spacer 14 is separate from the cable jacket 12. In this configuration, the wall portions 26, 28, 30 and 32 radiate from the center portion 24 and terminate proximate to the jacket 12. As shown in FIG. 1, the wall portions 26, 28, 30, and 32 of the communications cable 10 can be configured so as to define longitudinally extending passageways or compartments of a helical configuration within the cable jacket 12 so that the respective twisted pairs 16, 18, 20 and 22 located within the compartments extend helically around the longitudinal axis of the cable. Typically, the spacer 14 and the twisted pairs 16, 18, 20, and 22 are twisted to provide this helical configuration thereby holding these cable components together. Furthermore, this helical configuration improves the impedance uniformity of the cable by maintaining uniformity of spacing of the respective twisted pairs 16, 18, 20 and 22 despite bending of the cable 10. The cable components are twisted helically at a predetermined lay length defined as the length it takes for one of the cable components (e.g. twisted pairs) to make one complete helical turn. Preferably, the lay length is between about 3 and about 8 inches.

The communications cable 10 illustrated in FIGS. 1 and 2 is manufactured by extruding the spacer 14 using a suitable polymer material such as the materials described for use in the jacket 12. The spacer 14 is formed into a desired shape as it exits the extruder and is cooled or quenched to harden the spacer. The spacer 14 is then bunched with four twisted wire pairs 16, 18, 20 and 22 such that the twisted wire pairs are oriented in the grooves of the spacer. The spacer 14 and the twisted wire pairs 16, 18, 20, and 22 can also be twisted helically during the bunching process to increase impedance uniformity of the cable 10. Once the spacer 14 and the twisted wire pairs 16, 18, 20, and 22 are bunched, the jacket 12 is then extruded around the spacer 14 and twisted wire pairs 16, 18, 20 and 22 to form the cable 10.

The communications cable 10 of FIGS. 1 and 2 can be easily connected to other cable components. First, the jacket 12 is stripped from the cable 10 thus revealing the spacer 14 and the twisted pairs 16, 18, 20 and 22. The spacer 14 can then be pulled away from the twisted pairs 16, 18, 20 and 22 and clipped to the cable 10 to allow the twisted pairs to be connected to other cable components. Alternatively, the spacer 14 can be cut away to allow easy connectorization of the twisted pairs 16, 18, 20 and 22.

FIG. 3 illustrates another embodiment of the invention wherein the cable 50 comprises a cable jacket 52, a spacer 54 extending longitudinally within the cable jacket, and twisted pairs of insulated conductors 56, 58, 60 and 62. In this embodiment, the spacer 54 has a longitudinally extending center portion 64 and a plurality of longitudinally extending wall portions 66, 68, 70 and 72 radiating from the center portion to the cable jacket 52 and connected to the cable jacket. The spacer 54 and jacket 52 define compartments 74, 76, 78 and 80 for receiving the twisted pairs of insulated conductors 56, 58, 60 and 62. As illustrated in FIG. 3, the longitudinally extending wall portions 66, 68, 70 and 72 preferably increase in thickness from the center portion 64 to the jacket 52. The wall portions 66, 68, 70 and 72 are thin to allow the wall portions to be broken thereby permitting easy connectorization of the twisted pairs 56, 58, 60 and 62 as described in more detail below. Preferably, the thickness of the wall portions 66, 68, 70 and 72 is not greater than 8 mils.

The embodiment illustrated in FIG. 3 is produced by first bunching the twisted pairs 56, 58, 60 and 62 together and advancing the twisted pairs to an extrusion apparatus. A polymer melt of suitable jacket material is then extruded around the twisted pairs to form the jacket 52 and the spacer 54 as an integral unit. Alternatively, the embodiment illustrated in FIG. 3 can be manufactured similarly to the embodiment in FIGS. 1 and 2 by extruding the jacket 52 such that the jacket 52 becomes integrally bonded to the wall portions 66, 68, 70 and 72 of the spacer 54.

The communications cable 50 of FIG. 3 can be easily connected to other cable components. The typically method of connectorization is to first strip the jacket 52 from the cable 50. The spacer 54 and the jacket 52 are then removed by breaking off the spacer in the area where the jacket 52 is stripped. The thin wall portions 66, 68, 70 and 72 of the spacer 54 allow the spacer to be easily broken off to expose the twisted pairs 56, 58, 60 and 62. The twisted pairs 56, 58, 60 and 62 can then be easily connected to other cable components.

FIG. 4 illustrates a comparison between the cross talk of the twisted pairs of a conventional bunched cable having no spacer and the communications cable according to FIGS. 1 and 2. Specifically, FIG. 4 illustrates the cross talk between the twisted pairs of insulated conductors of these cables with Bl=blue, Or=orange, Wh=white, and Br=brown. In FIG. 4, the solid trace corresponds to the conventional cable construction with no spacer, the short dashed trace corresponds to the cable of FIGS. 1 and 2, and the long dashed trace corresponds to the Category 6 586A requirement proposed by TIA/EIA. As shown in FIG. 4, the cross talk of the communications cable 10 of the invention is well below the Category 6 586A requirement proposed by TIA/EIA. Furthermore, the cross talk measurements of the communications cable 10 average 8 to 10 dB better than the cross talk measurements of the conventional cable construction.

The twisted pair communications cable of the invention in operation minimizes cross talk between the twisted pairs of insulated conductors and is an improvement over conventional twisted pair communications cable designs. Specifically, as illustrated in FIG. 4, the twisted pair communications cable of the invention reduces cross talk by as much as 10 dB over conventional cables which do not use spacer constructions. Moreover, the twisted pair cable of the invention minimizes capacitance imbalance as desired for such cables. The communications cable of the invention can be easily connectorized by splitting open the thin jacket and removing the spacer to allow the insulated conductors to be connected to the appropriate connections.

It is understood that upon reading the above description of the present invention and reviewing the accompanying drawings, one skilled in the art could make changes and variations therefrom. These changes and variations are included in the spirit and scope of the following appended claims.

What is claimed is:

1. A communications cable consisting essentially of:

a cable jacket;

a spacer extending within said cable jacket, said spacer having a longitudinally extending center portion and plurality of longitudinally extending wall portions radiating from said center portion, said longitudinally extending wall portions increasing in thickness from said center portion to said jacket, said spacer and said cable jacket defining a plurality of compartments within said cable jacket; and a twisted pair of insulated conductors disposed in respective ones of said compartments, each of said twisted pairs of insulated conductors having a different lay length.

2. The communications cable according to claim 1 wherein the wall portions of said spacer extend to said cable jacket and are connected to said cable jacket.

3. The communications cable according to claim 1 wherein said spacer is separate from said cable jacket.

4. The communications cable according to claim 3 wherein said cable includes a longitudinal axis, said wall portions are configured so as to define compartments of a helical configuration within the cable jacket, and the twisted pairs located within said compartments extend helically about the longitudinal axis of the cable.

5. The communications cable according to claim 4 wherein the twisted pairs extend helically at a lay length of between about 3 inches and about 8 inches.

6. A communications cable consisting essentially of:

a tubular cable jacket;

a spacer situated within said cable jacket and separate from said cable jacket, said spacer having a longitudinally extending center portion and a plurality of longitudinally extending wall portions radiating form said center portion, said longitudinally extending wall portions increasing in thickness from said center portion to said jacket, said spacer and said cable jacket defining a plurality of compartments within the cable jacket; and a twisted pair of insulated conductors disposed in each of said compartments, each of said twisted pairs of insulated conductors has a different lay length.

7. The communications cable according to claim 6 wherein said cable includes a longitudinal axis, said wall portions are configured so as to define passageways of a helical configuration within the cable jacket, and the twisted pairs located within said passageways extend helically about the longitudinal axis of the cable.

8. The communications cable according to claim 7 wherein the twisted pairs extend helically at a lay length of between about 3 inches and about 8 inches.

9. The communications cable according to claim 6 wherein said spacer defines four compartments within the cable jacket.

10. A communication cable comprising:

a tubular cable jacket;

a spacer extending longitudinally within said cable jacket, said spacer having a longitudinally extending center portion and a plurality of longitudinally extending wall portions radiating from said center portion to said cable jacket and connected thereto, said longitudinally extending wall portions increasing in thickness from said center portion to said jacket, said spacer and said cable jacket defining a plurality of a compartments; and a twisted pair of insulated conductors disposed in each of said compartments.

11. The communications cable according to claim 10 wherein each of said twisted pairs of insulated conductors has a different lay length.

12. The communications cable according to claim 10 wherein said longitudinally extending wall portions have a thickness of less than about 8 mils.

13. The communications cable according to claim 10 wherein said spacer and said jacket define four compartments.

* * * * *